US011738433B2

(12) United States Patent
Grandjean et al.

(10) Patent No.: US 11,738,433 B2
(45) Date of Patent: Aug. 29, 2023

(54) FASTENER DRIVING TOOL

(71) Applicant: Illinois Tool Works Inc., Glenview, IL (US)

(72) Inventors: Pascale Grandjean, Guilherand-Granges (FR); Médéric Cartier, Etables (FR); Romain Nony, Glenview, IL (US)

(73) Assignee: Illinois Tool Works Inc., Glenview, IL (US)

( * ) Notice: Subject to any disclaimer, the term of this patent is extended or adjusted under 35 U.S.C. 154(b) by 109 days.

(21) Appl. No.: 17/392,958

(22) Filed: Aug. 3, 2021

(65) Prior Publication Data

US 2022/0048174 A1 Feb. 17, 2022

(30) Foreign Application Priority Data

Aug. 11, 2020 (EP) ..... 20190451
May 26, 2021 (EP) ..... 21175842

(51) Int. Cl.
*B25C 1/08* (2006.01)

(52) U.S. Cl.
CPC ..... *B25C 1/08* (2013.01)

(58) Field of Classification Search
CPC .. B25C 1/08; B25C 1/00; B25C 1/082; B25C 1/10; B25C 1/085; B25C 1/087; B25C 1/008
See application file for complete search history.

(56) References Cited

U.S. PATENT DOCUMENTS 3,850,359 A 11/1974 Obergfell
6,123,241 A * 9/2000 Walter ..... B25C 1/008 227/8

(Continued)

FOREIGN PATENT DOCUMENTS

EP 1 391 270 2/2004

OTHER PUBLICATIONS

Extended European Examination Report form European Application No. 21175842.0, dated Nov. 23, 2021 (8 pages).

*Primary Examiner* — Anna K Kinsaul
*Assistant Examiner* — Veronica Martin
(74) *Attorney, Agent, or Firm* — Neal, Gerber & Eisenberg LLP

(57) ABSTRACT

A fastener driving tool for fixation of parts by way of nails or staple propelled by a driving piston under the effect of the combustion of one or more fluids. More specifically, a device of controlling the relative proportions of the fluids used for combustion including a combustion chamber having a first inlet port for inputting a first fluid having at least one variable fluid characteristic, and a second inlet port for inputting a second fluid. A first actuator is operably coupled to said first inlet port, adapted to switch between a first open state, allowing said first fluid to move into said combustion chamber at a first mass flow rate that is dependent on said at least one variable fluid characteristic, and a first closed state, preventing or at least limiting said first fluid from moving into said combustion chamber. A second actuator is operably coupled to said second inlet port, adapted to switch between a second open state, allowing said second fluid to move into said combustion chamber at a second mass flow rate, and a second closed state, preventing said second fluid from moving into said combustion chamber. A controller is configured to operate any one of said first and second actuators and to control a time interval of said first open state and/or (Continued)

said second open state based on at least one predetermined parameter, so as to provide a predetermined mass ratio of said first and second fluid within said combustion chamber.

23 Claims, 4 Drawing Sheets

(56) References Cited

U.S. PATENT DOCUMENTS

| | | | | |
|---|---|---|---|---|
| 6,145,724 | A | 11/2000 | Shkolnikov et al. | |
| 6,755,159 | B1 | 6/2004 | Adams et al. | |
| 6,912,988 | B2 | 7/2005 | Adams | |
| 7,584,723 | B2 | 9/2009 | Shkolnikov et al. | |
| 8,087,394 | B2 | 1/2012 | Adams | |
| 9,492,915 | B2 | 11/2016 | Largo et al. | |
| 9,638,092 | B2 | 5/2017 | Adams | |
| 9,643,306 | B2 | 5/2017 | Largo et al. | |
| 9,770,818 | B2 | 9/2017 | Largo | |
| 2002/0134069 | A1 | 9/2002 | Adams | |
| 2002/0134345 | A1 | 9/2002 | Adams | |
| 2002/0144498 | A1 | 10/2002 | Adams | |
| 2004/0045997 | A1 | 3/2004 | Birk et al. | |
| 2006/0226193 | A1 | 10/2006 | Toulouse | |
| 2006/0260310 | A1* | 11/2006 | Toulouse | B25C 1/08 60/632 |
| 2013/0048696 | A1 | 2/2013 | Largo et al. | |
| 2018/0036871 | A1 | 2/2018 | Cordeiro et al. | |

* cited by examiner

FASTENER DRIVING TOOL

PRIORITY

This patent application claims priority to and the benefit of European Patent Application No. 20190451.3, filed Aug. 11, 2020, and European Patent Application No. 21175842.0, filed May 26, 2021, the entire contents of each of which are incorporated herein by reference.

BACKGROUND

The present disclosure relates to a fastener driving tool for fixation of parts by way of fasteners propelled by a driving piston under the effect of the combustion of one or more fluids. More specifically, the present disclosure involves a device of controlling the input of combustion fluids.

Fastener driving tools include devices for driving fixation elements or fasteners, such as a nail or a staple, designed to be anchored in a material composing a work surface. A known tool is generally illustrated in FIG. 1, including a housing 1 with a handle 9 for grasping and handling and shooting, on which is mounted a trigger 10. The tool is gas-powered, i.e. the housing 1 is provided with an internal combustion engine 2 to generate a driving force for propulsion of a piston designed to drive a nail into a work surface. The engine 2 includes at least one combustion chamber 3 adapted to contain a mixture of fluids for combustion. Igniting the mixture by an internal ignition device provides a driving force, thereby propelling the piston to drive the nail through the exit of a guide tip 5. Ignition of the ignition device is initiated by the user depressing the trigger 10, generating an electric arc in the combustion chamber.

A combustible fluid mixture, typically an air and fuel mixture, is provided to the combustion chamber 3 for ignition. Fuel, such as a combustible gas or liquid, is inputted into the combustion chamber 3 by way of injection from a gas cartridge 4 retained in the housing 1. Air can be drawn into the combustion chamber 3 from the surrounding atmosphere by an electric fan.

A known problem of such fastener tools is that combustion is often not optimized, reducing tool efficiency, which leads to a loss of power in the tool and therefore to poor fastening quality, even having no explosion. Also, currently available tools are not capable to adapt to different environmental conditions (e.g. varying atmospheric pressure and/or temperature) leading to a potentially ineffective and poor performance of the tools.

SUMMARY

Various embodiments of the present disclosure provides a fastener driving tool with improved combustion efficiency. Various embodiments of the present disclosure provide a tool configured to adaptably optimize its combustion efficiency according to ambient conditions.

According to a first aspect of the present disclosure, there is provided a fastener driving tool, including: a combustion chamber having a first inlet port for inputting a first fluid having at least one variable fluid characteristic, and a second inlet port for inputting a second fluid; a first actuator, operably coupled to said first inlet port, adapted to switch between a first open state, allowing said first fluid to move into said combustion chamber at a first mass flow rate that is dependent on said at least one variable fluid characteristic, and a first closed state, preventing or at least limiting said first fluid from moving into said combustion chamber; a second actuator, operably coupled to said second inlet port, adapted to switch between a second open state, allowing said second fluid to move into said combustion chamber at a second mass flow rate, and a second closed state, preventing said second fluid from moving into said combustion chamber; and a controller, configured to operate any one of said first and second actuators and to control a time interval of said first open state and/or said second open state based on at least one predetermined parameter, so as to provide a predetermined mass ratio of said first and second fluid within said combustion chamber.

Advantageously, said first actuator can be a fan assembly configured so that, when in said first open state, said fan assembly moves said first fluid into said combustion chamber.

According to an aspect of the present disclosure, the fastener driving tool can comprise a mechanism to deactivate the fan assembly when in said first 'closed state'.

According to an aspect of the present disclosure, the mechanism to deactivate the fan assembly can comprise a switch between the fan assembly and a power supply Advantageously, the at least one predetermined parameter can be any one of the current ambient atmospheric pressure and a variable parameter of one or more component(s) of said fastener driving tool that is directly or indirectly affected by the current ambient atmospheric pressure.

In these ways, the mixture of fluids inputted into the combustion chamber ready for ignition can be optimised to maintain a desired ratio of first and second fluids. The respective masses of the first and second fluids can be controlled to provide an ideal stoichiometric ratio for combustion which, when ignited, efficiently provides sufficient driving force to propel a fixation element or fastener. Furthermore, an optimised ration can be maintained under varying operating environments.

Advantageously, the at least one predetermined parameter can be a measure of the electrical current consumed by said first actuator during said first open state.

Advantageously, said at least one predetermined parameter can be said first mass flow rate determined by a flowmeter during said first open state.

In these ways, the tool uses the at least one predetermined parameter to determine the first mass flow rate under the conditions of each firing cycle. Accordingly, the tool can adjust the first and/or second open state time interval in order to always provide an optimised mass ratio of the first and second fluids within the combustion chamber. Thus, one or both open state time intervals can be modified in order to accommodate different fluid pressures, temperatures or mass flow rates and still ensure an optimised mass ratio is provided within the chamber. Efficient combustion can be thus provided independent of fluid characteristics.

Advantageously, the second actuator can be a fluid valve configured to switch between an open position, allowing fluid flow into said combustion chamber, and a closed position, preventing fluid flow into said combustion chamber.

In various embodiments, the first fluid cam be ambient air.

In these ways, the tool can adapt to varying ambient atmospheric conditions. Efficient operation of the tool in different altitude or temperature environments can be achieved. In other words, an optimised mass ratio of the first and second fluids can be provided independent of the ambient conditions in which the operator uses the tool.

Advantageously, the second fluid can be a fluid with substantially constant fluid characteristics.

In various embodiments, the second fluid can be a combustible fuel.

In these ways, the tool can accommodate a supply of the second fluid from a fluid source such as a pressurised cartridge. As the fluid source provides the second fluid at constant pressure, the second mass flow rate can be easily determined. The controller is thus able to control the dose of the second fluid provided to the combustion chamber by simply controlling the second open state time interval. Where the second fluid is a combustible fuel then a precise mass of fuel can be easily provided.

According to an aspect of the present disclosure, the combustion chamber comprises an outlet port comprising a third actuator which is adapted to switch between an 'open state', in which combustion chamber is vented to the atmosphere, and a 'closed state' in which the third actuator prevents venting.

Advantageously, the controller comprises a way to monitor the electric current consumed by the first actuator.

According to an aspect of the present disclosure, the way to monitor the electric current consumed by the first actuator comprise a sensor. The controller is thus able to determine the electric current consumed by the first actuator during its 'open state' or 'closed state'.

Advantageously, the controller comprises a way to control the time interval of respective 'second open state' and 'second closed state' of the second actuator.

BRIEF DESCRIPTION OF THE DRAWINGS

Embodiments of the present disclosure are now described, by way of example only, hereinafter with reference to the accompanying drawings, in which.

In the drawings, like reference numerals refer to like parts.

DETAILED DESCRIPTION

Figure 1:
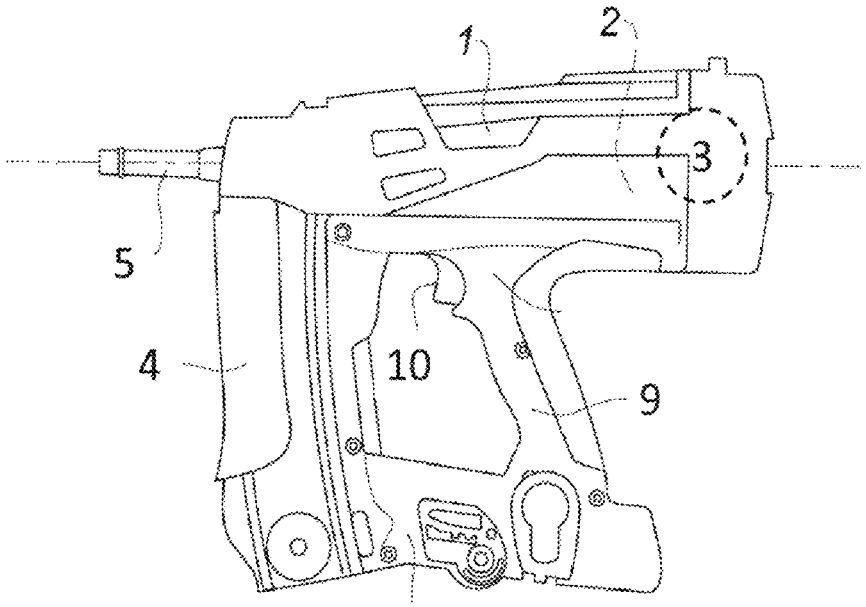
FIG. 1 (Prior Art)
FIG. 1 is a side view of a fastener driving tool of the prior art.

While the systems, devices, and methods described herein may be embodied in various forms, the drawings show and the specification describes certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as mounted, connected, etc., are not intended to be limited to direct mounting methods but should be interpreted broadly to include indirect and operably mounted, connected, and like mounting methods. This specification is intended to be taken as a whole and interpreted in accordance with the principles of the present disclosure and as understood by one of ordinary skill in the art.

As used herein, the terms 'connected', 'attached', 'coupled', 'operated' are intended to include direct connections between two members without any other members interposed therebetween, as well as, indirect connections between members in which one or more other members are interposed therebetween. The terminology includes the words specifically mentioned above, derivatives thereof, and words of similar import.

Further, unless otherwise specified, the use of ordinal adjectives, such as, 'first', 'second', 'third' etc. merely indicate that different instances of like objects are being referred to and are not intended to imply that the objects so described must be in a given sequence, either temporally, spatially, in ranking or in any other manner.

Figure 2:
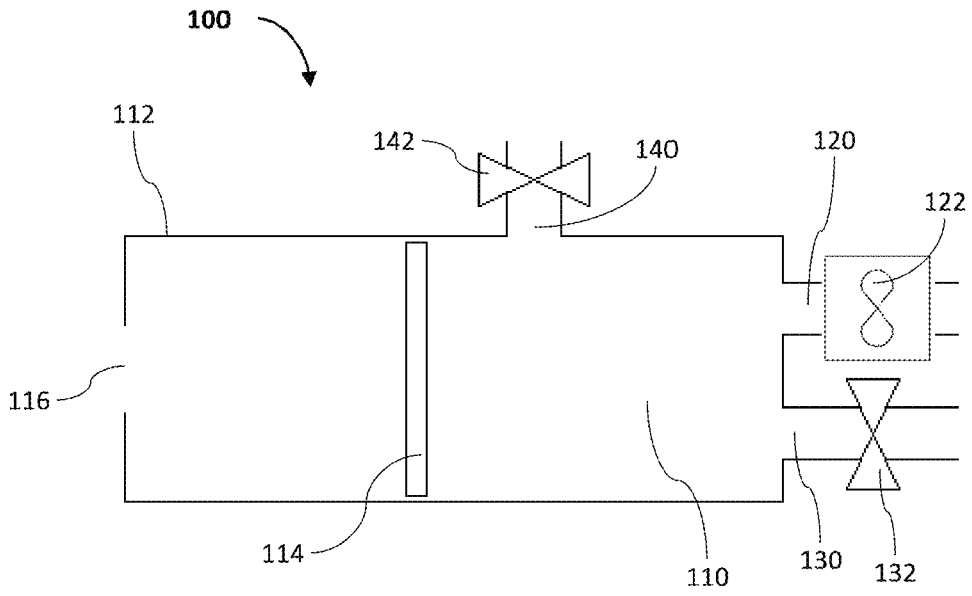
FIG. 2 is a schematic view of an example embodiment of the fastener driving tool of the present disclosure.

Referring now to FIG. 2, an example embodiment of a schematic view of a fastener driving tool 100 is shown according to the present disclosure. The fastener driving tool 100 includes a combustion chamber 110 with first and second inlet ports 120 and 130 for inputting respective first and second fluids into the combustion chamber 110. The first fluid can be air and the second fluid can be a standard fuel. The first inlet port 120 includes a first actuator and the second inlet port 130 includes a second actuator. Each one of the first and second actuators is adapted to switch between (a) an open state, allowing the respective first or second fluid to move into the combustion chamber 110 at a respective first or second mass flow rate, and (b) a closed state, in which respective first and second fluid is prevented from moving into the combustion chamber 110. A controller is configured to operate any one of the first and second actuators and control the time interval of the 'open state(s)' based on at least one predetermined parameter in order to provide a predetermined mass ratio of the first and second fluids within the combustion chamber 110.

In this particular example, the first actuator is a fan assembly 122 that is configured to switch between an open and a closed state. When in the 'open state' the fan assembly 122 is activated so as to draw in air from the ambient atmosphere and move the air into the combustion chamber 110. According to an aspect of the present disclosure, the fastener driving tool 100 comprises a mechanism to deactivate the fan assembly when in the first 'closed state'. Advantageously, the fastener driving tool comprises a mechanism to activate and/or deactivate the fan assembly. When in the 'closed state', the fan assembly is deactivated. Activation and deactivation of the fan can simply be provided by a switch between the fan assembly 122 and its power supply.

The second actuator can be a valve assembly 132 configured to switch between an 'open state' and a 'closed state'. The valve assembly 132 is operably connected to a fuel source, for example, in the form of a pressurised cartridge adapted to provide combustible fluid at constant, elevated pressure. When in the 'open state', the valve assembly 132 allows combustible fluid to move into the combustion chamber 110 from the fuel source. When in the 'closed state', the fuel source is isolated from the combustion chamber 110.

Furthermore, the combustion chamber 110 is provided with an outlet port 140 having a third actuator 142 that is adapted to switch between (a) an 'open state', in which combustion chamber 110 is vented to the atmosphere, and (b) a 'closed state' in which the third actuator 142 prevents venting.

An ignition device (not shown) can be provided within the combustion chamber 110, adapted to generate an electric arc in order to ignite the combustible fluid mixture within the combustion chamber 110. Ignition is typically initiated by the user depressing a trigger (not shown) of the fastener driving tool 100.

The fastener driving tool 100 is further provided with a cylinder 112 extending between the combustion chamber 110 at a proximal end of the cylinder 112 and an exit 116 at a distal end. The exit 116 leads to a guide tip (not shown) on the front of the fastener driving tool 100 adapted to direct a fastener into a work surface. A piston 114 is provided in the cylinder 112, adapted to move from the proximal end towards the distal end under a driving force provided from within the combustion chamber 110.

Operation of the fastener driving tool 100 will now be described with further reference to FIG. 3, which shows a simplified schematic illustration of the control system 150. The control system 150 is provided with a controller 152 operably adapted to provide independent digital output signals to first and second power drivers 124 and 134.

The output signal provided to the first power driver 124 causes the first power driver 124 to switch the fan assembly 122 between its 'open state' and 'closed state'. Thus, by varying the output signal to the first power driver, the controller 152 is able to control the time intervals for respective 'open state' and 'closed state' of the fan assembly 122.

At the same time, the controller 152 monitors (here, the controller comprises a mechanism to monitor the electric current consumed by the first actuator) the electric current consumed by the fan assembly 122 via sensor 126 (here a mechanism to monitor the electric current consumed by the first actuator that comprise a sensor). This provides a feedback signal to the controller 152 via a convertor 154. The controller 152 is thus able to determine the electric current consumed by the fan assembly 122 during its 'open state' or 'closed state'.

The output signal provided to the second power driver 134 causes the second power driver 134 to switch the valve assembly 132 between its 'open state' and its 'closed state'. In this way, the controller 152 controls the time interval of respective 'open state', as well as, 'closed state' of the valve assembly 132. The controller 152 comprises a mechanism to control the time interval of respective 'second open state' and 'second closed state' of the valve assembly 132 (second actuator).

When the fastener driving tool 100 is in use, the combustion chamber 110 is prepared for a firing cycle by inputting a mixture of air and fuel to the chamber. The controller 152 provides an output signal to the first power driver 124 causing the fan assembly 122 to switch to an 'open state' and thereby move air into the combustion chamber 110. The controller 152 provides an output signal to the second power driver 134 causing the valve assembly 132 to switch into an 'open state' and thereby move fuel into the combustion chamber 110. In the example shown, the controller 152 provides the output signals sequentially so that air is provided to the combustion chamber 110 before fuel. However, equally, the controller 152 can provide output signal(s) which provide the air and fuel in any sequence, including wholly or partly within the same time period.

When in the 'open state', the fan assembly 122 draws air into the combustion chamber 110 at a first mass flow rate. The specific mass flow rate during an individual 'open state' is dependent on the characteristics of the ambient air itself at that time. In particular, the inventor has appreciated that the first mass flow rate depends on the ambient atmospheric pressure. Thus, when the atmospheric pressure is low, for example if the fastener driving tool 100 is used at high altitude, then the air density is relatively low and the electrical current consumed by the fan assembly 122 is correspondingly lower (compared to a standard mass flow rate at standard environmental conditions). Conversely, when atmospheric pressure is high, for example if the fastener driving tool 100 is used at low altitude, then the air density is higher and the electrical current consumed by the fan assembly 122 is correspondingly higher.

Figure 4:
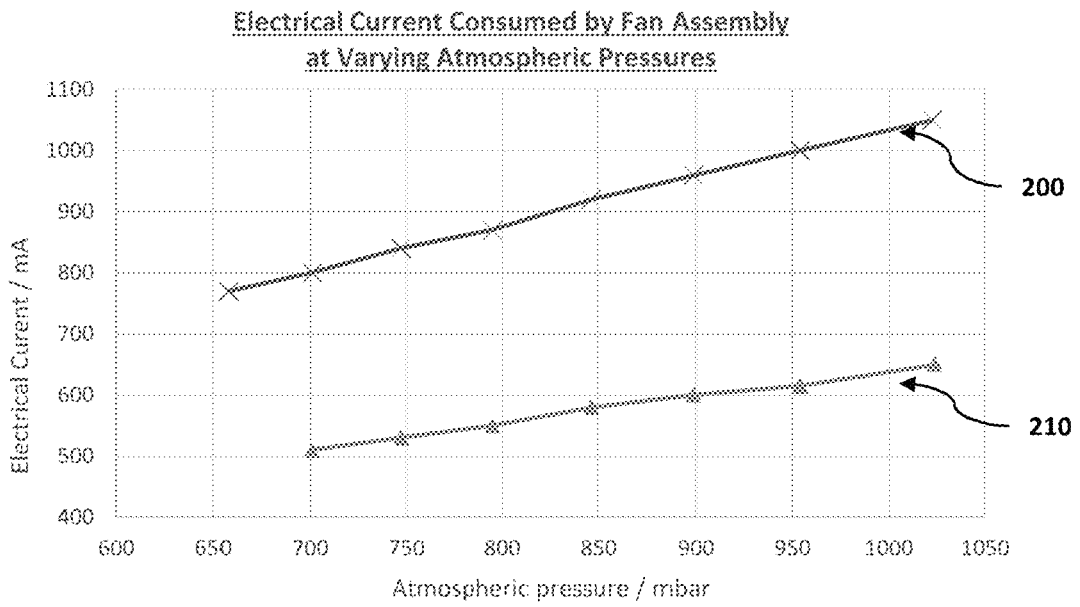
FIG. 4 shows empirical data of the electrical current drawn under different operating conditions by the fan assembly of the example fastener driving tool of FIG. 2.

FIG. 4 shows empirical data of the electrical current consumed by the fan assembly 122 in an 'open state' at varying atmospheric pressures. The data has a first series 200 of measurements, taken with the third actuator 142 of the outlet port 140 in an 'open state' such that the combustion chamber 110 vented to the atmosphere, and a second series 210 of measurements, taken with the third actuator 142 in a 'closed state' thereby preventing venting of the combustion chamber 110. The first and second series each comprise measurements taken across substantially overlapping ranges of atmospheric pressure between 650 and 1030 millibar. Under the respective conditions of both the first and second series 200 and 210, the electrical current consumed by the fan assembly 122 increases as the atmospheric pressure increases. However, the electrical current consumed by the fan assembly 122 at any particular atmospheric pressure differs depending on whether the third actuator 142 is in an 'open state' or 'closed state'. Thus, the first series 200 of measurements shows electrical current increasing from 770 to 1050 milliamps (mA) within its tested range, and the second series 210 shows electrical current increasing from 510 to 650 mA within its tested range.

As the electrical current consumed by the fan assembly 122 is monitored by sensor 126 during any 'open state' and then fed back to the controller 152, the controller 152 is able to determine the air mass flow rate and the mass of air inputted into the combustion chamber 110 for the upcoming firing cycle (e.g., interpolation from the performance data of the fan assembly at different electrical current consumptions).

When the valve assembly 132 is switched to the 'open state' by the controller 152, the elevated pressure of the fuel source causes combustible fluid to move into combustion chamber at a predetermined fuel mass flow rate. The time interval for the second 'open state' is determined by the controller based on the feedback signal of the sensor 126 (i.e., the current air mass flow rate and the amount of air moving into the chamber) in order to adapt the mass of fuel moved into the combustion chamber 110, so as to optimize the fuel/air mixture for optimal combustion. Therefore, an optimum fuel/air mixture is provided irrespective of the ambient atmospheric pressure or any other environmental parameter.

Once the optimal fuel/air mixture has entered the combustion chamber 110, the firing cycle commences igniting the mixture by the ignition device, generating a driving force to propel the piston and drive a fastener into a work surface.

After firing and combustion is complete, the combusted fluids are purged from the combustion chamber 110 in readiness for preparing the next firing cycle. Thus, the third actuator 142 is switched to an 'open state', via a third power driver, by the controller 152 to allow the combusted fluids to be vented to the atmosphere. In order to accelerate the venting, the controller switches the fan assembly 132 into an 'open state' to simultaneously draw fresh air into the combustion chamber 110 and displace the combusted fluids vented through the outlet port. With the combusted fluids purged, the controller 152 is ready to initiate preparation for the next firing cycle.

In the example embodiment, the controller 152 bases the time interval of the valve assembly 'open state' on the electrical current consumed by the fan assembly 122 during preparation for the firing stage. In other words, the electrical current consumed by the fan assembly 122 when the outlet port 140 is closed.

Alternatively, the controller 150 can base the time interval on the current consumed by the fan assembly when the third actuator is open. In other words, the controller can respond to feedback from the sensor 126 when the fan assembly 122 is providing air to displace combusted fluids in the combustion chamber. To this extent, when controlling a time interval, the controller can evaluate, whether the third actuator 142 is in an 'open state' or 'closed state', in order to determine its response to the feedback of the sensor 126.

Additionally, it should be understood by the person skilled in the art that the controller 150 can base a time interval ('closed state' and/or 'open state') of either one of the first or second actuator on any other indicator signal suitable for determining the ambient atmospheric pressure. The indicator can be a direct measurement, for example, from a pressure sensor directly coupled to the controller 150, or a pressure measurement from a pressurised fluid source. Further, the indicator signal can be provided by one or more indirect measurement, such as, for example, the rotational speed of the fan assembly 122, or a flow rate measurement device suitably positioned (e.g., at the inlet port of the fan assembly 122). The indicator signal can also be provided from a remote sensor, for example, atmospheric data provided from another device over a suitable wired or wireless connection (e.g., a mobile phone application).

Additionally, or alternatively, the controller 126 can base the time interval of the 'open state' of any one of the first or second actuator on any other data suitable to derive the amount of air and/or fuel mass moved into the combustion chamber at a predetermined time interval (e.g., ambient temperature or relative humidity).

Any indicator signal, data or measurement provided to the controller can be provided directly or via a suitable intermediary module, for example an analogue-to-digital convertor or wireless receiver.

Any suitable actuators capable of providing fluids to the combustion chamber can be used, in any appropriate combination. For example, pumps or injectors, or any other device or apparatus capable of selectively inputting fluids for a time interval controlled by the controller. Any such devices or apparatus can include or exclude additional features required to enable them to function with a fastener driving tool.

Figure 3:
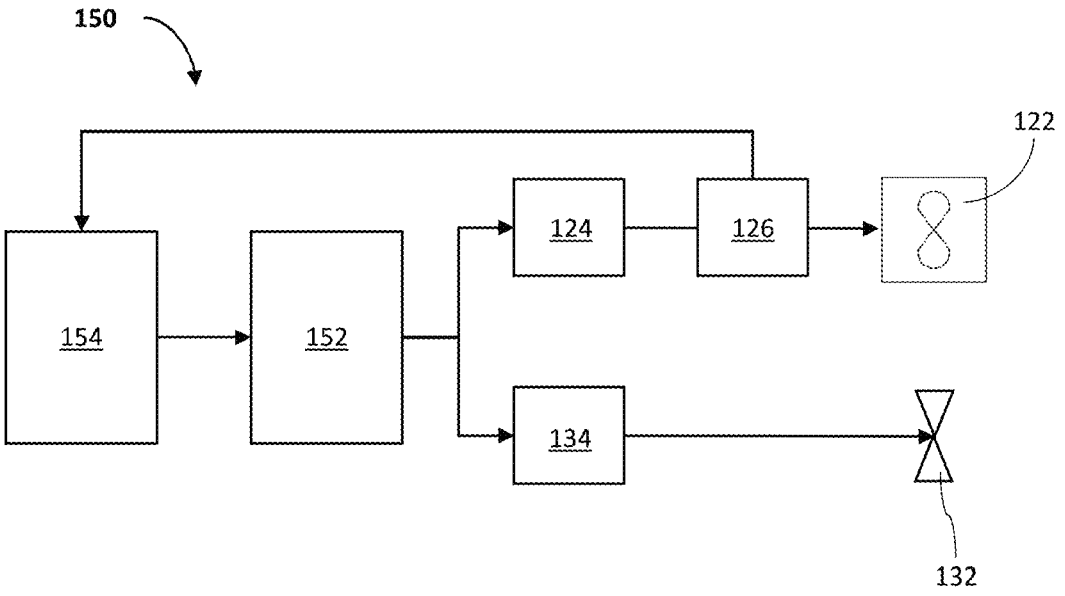
FIG. 3 is a schematic layout of the control system of the example fastener driving tool of FIG. 2.

In example embodiment of FIGS. 2 and 3, the controller 150 controls the time interval of the second actuator based on a parameter associated with the first actuator, so that the time interval of the constant pressure fuel source is controlled depending on a variable characteristic of the ambient atmospheric air. However, other way of control are possible, which enable either one (or both) of the time intervals to be controlled based on characteristics of one or both fluids. For example, the time interval of the actuator inputting a fluid with a variable characteristic, such as air, can be based on the fixed pressure and time interval of a fluid provided from a pressurised fluid cartridge. Thus, many variations and combinations of parameters and controls can be adapted in order that the final mixture of fluids within the combustion chamber contains an optimum mass ratio for the specific fluids being used.

Additionally, or alternatively, the controller can adapt to varying fluids such that the time intervals can be adjusted to provide different mass ratios depending on the fluids being used.

The invention claimed is:

1. A fastener driving tool comprising:

a combustion chamber having (i) a first inlet port configured to input a first fluid having at least one variable fluid characteristic, (ii) a second inlet port configured to input a second fluid, and (iii) an outlet port;

a first actuator operably coupled to the first inlet port, the first actuator configured to switch between (a) a first open state enabling the first fluid to move into the combustion chamber at a first mass flow rate that is dependent on the at least one variable fluid characteristic, and (b) a first closed state limiting the first fluid from moving into the combustion chamber;

a second actuator operably coupled to the second inlet port, the second actuator configured to switch between (a) a second open state enabling the second fluid to move into the combustion chamber at a second mass flow rate, and (b) a second closed state limiting the second fluid from moving into the combustion chamber;

a third actuator operably coupled to the outlet port and configured to switch between (a) a third open state in which the combustion chamber is vented to atmosphere, and (b) a closed state in which the third actuator limits venting of the combustion chamber; and a controller configured to operate the first, second, and third actuators, and to control a time interval of the first open state and/or the second open state based on at least one predetermined parameter, so as to provide a predetermined mass ratio of the first fluid and the second fluid within the combustion chamber.

2. The fastener driving tool of claim 1, wherein the first actuator includes a fan assembly configured so that, when in the first open state, the fan assembly moves the first fluid into the combustion chamber.

3. The fastener driving tool of claim 2, which includes means for deactivating the fan assembly when in the first closed state.

4. The fastener driving tool of claim 3, wherein the means for deactivating the fan assembly includes a switch between the fan assembly and a power supply.

5. The fastener driving tool of claim 1, wherein the at least one predetermined parameter is any one of: (a) a current ambient atmospheric pressure and (b) a variable parameter of one or more components of the fastener driving tool that is directly or indirectly affected by the current ambient atmospheric pressure.

6. The fastener driving tool of claim 1, wherein the at least one predetermined parameter is a measure of electrical current consumed by the first actuator when in the first open state.

7. The fastener driving tool of claim 1, wherein the at least one predetermined parameter is the first mass flow rate determined by a flowmeter when the first actuator is in the first open state.

8. The fastener driving tool of claim 1, wherein the second actuator is a fluid valve configured to switch between (a) an open position enabling fluid flow into the combustion chamber, and (b) a closed position limiting fluid flow into the combustion chamber.

9. The fastener driving tool of claim 1, wherein the first fluid is ambient air.

10. The fastener driving tool of claim 1, wherein the second fluid is a fluid having substantially constant fluid characteristics.

11. The fastener driving tool of claim 10, wherein the second fluid is a combustible fuel.

12. The fastener driving tool of claim 1, wherein the controller is configured to monitor electric current consumed by the first actuator.

13. The fastener driving tool of claim 1, wherein the controller is configured to monitor electric current consumed by the first actuator based on readings from a sensor.

14. The fastener driving tool of claim 1, wherein the controller is configured to control time intervals of the second open state and the second closed state of the second actuator.

15. A fastener driving tool comprising:

a combustion chamber having (i) a first inlet port configured to input a first fluid including ambient air that has a variable fluid characteristic based on a current ambient atmospheric pressure, (ii) a second inlet port configured to input a second fluid, and (iii) an outlet port;

a first actuator operably coupled to the first inlet port, the first actuator configured to switch between (a) a first open state enabling the first fluid to move into the combustion chamber at a first mass flow rate that is dependent on the current ambient atmospheric, and (b) a first closed state limiting the first fluid from moving into the combustion chamber;

a second actuator operably coupled to the second inlet port, the second actuator configured to switch between (a) a second open state enabling the second fluid to move into the combustion chamber at a second mass flow rate, and (b) a second closed state limiting the second fluid from moving into the combustion chamber;

a third actuator operably coupled to the outlet port and configured to switch between (a) a third open state in which the combustion chamber is vented to atmosphere, and (b) a closed state in which the third actuator limits venting of the combustion chamber; and a controller configured to operate the first, second, and third actuators, and to control a time interval of the first open state and/or the second open state based on the current ambient atmospheric pressure, so as to provide a predetermined mass ratio of the first fluid and the second fluid within the combustion chamber.

16. The fastener driving tool of claim 15, wherein the first actuator includes a fan assembly configured so that, when in the first open state, the fan assembly moves the first fluid into the combustion chamber.

17. The fastener driving tool of claim 15, wherein the second actuator is a fluid valve configured to switch between (a) an open position enabling fluid flow into the combustion chamber, and (b) a closed position limiting fluid flow into the combustion chamber.

18. The fastener driving tool of claim 15, wherein the second fluid is a combustible fuel.

19. A fastener driving tool comprising:

a combustion chamber having (i) a first inlet port configured to input a first fluid having at least one variable fluid characteristic, and (ii) a second inlet port configured to input a second fluid;

a first actuator operably coupled to the first inlet port, the first actuator configured to switch between (a) a first open state enabling the first fluid to move into the combustion chamber at a first mass flow rate that is dependent on the at least one variable fluid characteristic, and (b) a first closed state limiting the first fluid from moving into the combustion chamber;

a second actuator operably coupled to the second inlet port, the second actuator configured to switch between (a) a second open state enabling the second fluid to move into the combustion chamber at a second mass flow rate, and (b) a second closed state limiting the second fluid from moving into the combustion chamber;

a controller configured to operate the first and second actuators and to control a time interval of the first open state and/or the second open state based on a measure of electrical current consumed by the first actuator when in the first open state, so as to provide a predetermined mass ratio of the first fluid and the second fluid within the combustion chamber.

20. A fastener driving tool comprising:

a combustion chamber having (i) a first inlet port configured to input a first fluid having at least one variable fluid characteristic, and (ii) a second inlet port configured to input a second fluid;

a first actuator operably coupled to the first inlet port, the first actuator configured to switch between (a) a first open state enabling the first fluid to move into the combustion chamber at a first mass flow rate that is dependent on the at least one variable fluid characteristic, and (b) a first closed state limiting the first fluid from moving into the combustion chamber;

a second actuator operably coupled to the second inlet port, the second actuator configured to switch between (a) a second open state enabling the second fluid to move into the combustion chamber at a second mass flow rate, and (b) a second closed state limiting the second fluid from moving into the combustion chamber; and a controller configured to operate the first and second actuators and to control a time interval of the first open state and/or the second open state based on a measure of electrical current consumed by the first actuator when in the first open state, so as to provide a predetermined mass ratio of the first fluid and the second fluid within the combustion chamber.

21. A fastener driving tool comprising:

a combustion chamber having (i) a first inlet port configured to input a first fluid having at least one variable fluid characteristic, and (ii) a second inlet port configured to input a second fluid;

a first actuator operably coupled to the first inlet port, the first actuator configured to switch between (a) a first open state enabling the first fluid to move into the combustion chamber at a first mass flow rate that is dependent on the at least one variable fluid characteristic, and (b) a first closed state limiting the first fluid from moving into the combustion chamber;

a second actuator operably coupled to the second inlet port, the second actuator configured to switch between (a) a second open state enabling the second fluid to move into the combustion chamber at a second mass flow rate, and (b) a second closed state limiting the second fluid from moving into the combustion chamber; and a controller configured to operate the first and second actuators and to control a time interval of the first open state and/or the second open state based on at least one predetermined parameter, so as to provide a predetermined mass ratio of the first fluid and the second fluid within the combustion chamber, wherein the at least one predetermined parameter include the first mass flow rate determined by a flowmeter when the first actuator is in the first open state.

22. A fastener driving tool comprising:

a combustion chamber having (i) a first inlet port configured to input a first fluid having at least one variable fluid characteristic, and (ii) a second inlet port configured to input a second fluid;

a first actuator operably coupled to the first inlet port, the first actuator configured to switch between (a) a first open state enabling the first fluid to move into the combustion chamber at a first mass flow rate that is dependent on the at least one variable fluid characteristic, and (b) a first closed state limiting the first fluid from moving into the combustion chamber;

a second actuator operably coupled to the second inlet port, the second actuator configured to switch between (a) a second open state enabling the second fluid to move into the combustion chamber at a second mass flow rate, and (b) a second closed state limiting the second fluid from moving into the combustion chamber;

a controller configured to operate the first and second actuators and to control a time interval of the first open state and/or the second open state based on at least one predetermined parameter, so as to provide a predetermined mass ratio of the first fluid and the second fluid within the combustion chamber, wherein the controller is configured to monitor electric current consumed by the first actuator.

23. The fastener driving tool of claim 22, wherein the controller is configured to monitor electric current consumed by the first actuator based on readings from a sensor.

* * * * *